US005740951A

United States Patent [19]

Jack

[11] Patent Number: 5,740,951

[45] Date of Patent: Apr. 21, 1998

[54] INSULATED BELT ATTACHED BEVERAGE CAN HOLDER

[76] Inventor: Jeanette Jack, 56765 Scheuer Rd., Chesterfield, Mich. 48051

[21] Appl. No.: 826,579

[22] Filed: Apr. 3, 1997

[51] Int. Cl.[6] ..... A45F 5/00

[52] U.S. Cl. ..... 224/148.3; 224/148.1; 224/148.4; 224/148.7; 220/903; 62/457.4

[58] Field of Search ..... 224/148.1, 148.2, 224/148.3, 148.4, 148.7, 190, 195, 675; 62/457.3, 457.4; 220/903; D3/229

[56] References Cited

U.S. PATENT DOCUMENTS 4,872,577 10/1989 Smith ..... 220/85 CH
4,927,047 5/1990 Stuber et al. ..... 220/90.2
5,048,734 9/1991 Long ..... 224/148
5,251,460 10/1993 DeMarco et al. ..... 62/371

*Primary Examiner*—Henry J. Recla
*Assistant Examiner*—Timothy L. Maust
*Attorney, Agent, or Firm*—Henderson & Sturm

[57] ABSTRACT

An insulated belt attached beverage can holder 10 including a receptacle member 20 provided with a belt clip member 40 and a receptacle lid member 30 operatively attached to the receptacle member 20 and the receptacle lid member 30 for forming a secondary releasable belt encircling arrangement around the user's belt 200 in cooperating with the operative engagement of the receptacle lid member 30 and the receptacle member 20 with the beverage can 100.

6 Claims, 1 Drawing Sheet

INSULATED BELT ATTACHED BEVERAGE CAN HOLDER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of insulated beverage holders in general, and in particular to an insulated belt attached beverage holder having a unique cooperation between the receptacle and the lid of the beverage holder which provides a fail safe mechanism for the primary belt attaching mechanism.

2. Description of Related Art

As can be seen by reference to the following U.S. Pat. Nos. 4,872,577; 4,927,047; 5,048,734; and 5,251,460; the prior art is replete with myriad and diverse insulated beverage can holders.

While all of the aforementioned prior art constructions are more than adequate for the basic purpose and function for which they have been specifically designed, they are uniformly deficient with regard to providing a fail safe means for insuring that the beverage can holder will remain attached to a user's belt even in the event that the primary belt attaching mechanism experiences a structural failure or is dislodged from engagement with the user's belt.

Unfortunately, up until the present time the prior art devices have relied solely on the belt attaching mechanism to maintain the operative engagement between the beverage can holder and a user's belt with predictable consequences when the belt attaching mechanism either fails or is dislodged from engagement with the user's belt.

As a consequence of the foregoing situation, there has existed a longstanding need among users of belt attached beverage can holders for a new type of arrangement wherein the hinge element of the beverage can holder acts as an auxiliary belt retention member to insure that the beverage holder remains attached to the user's belt even if the primary belt attachment fails and the provision of such a construction is a stated objective of the present invention.

BRIEF SUMMARY OF THE INVENTION

Briefly stated, the insulated belt attached beverage can holder that forms the basis of the present invention comprises in general, a receptacle unit, a receptacle lid unit, a belt clip unit and a tether hinge unit wherein the belt clip unit is operatively attached to the beverage receptacle unit and the tether/hinge unit forms the operative attachment between the receptacle unit and the receptacle lid unit.

As will be explained in greater detail further on in the specification, the belt clip unit comprises the primary mechanism for attaching the receptacle unit to a user's belt, and the tether/hinge unit not only provides the operative attachment between the receptacle unit and the receptacle lid unit, but also provides an auxiliary belt retention member should the belt clip unit be dislodged from the belt or experience a structural failure.

BRIEF DESCRIPTION OF THE SEVERAL VIEWS OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
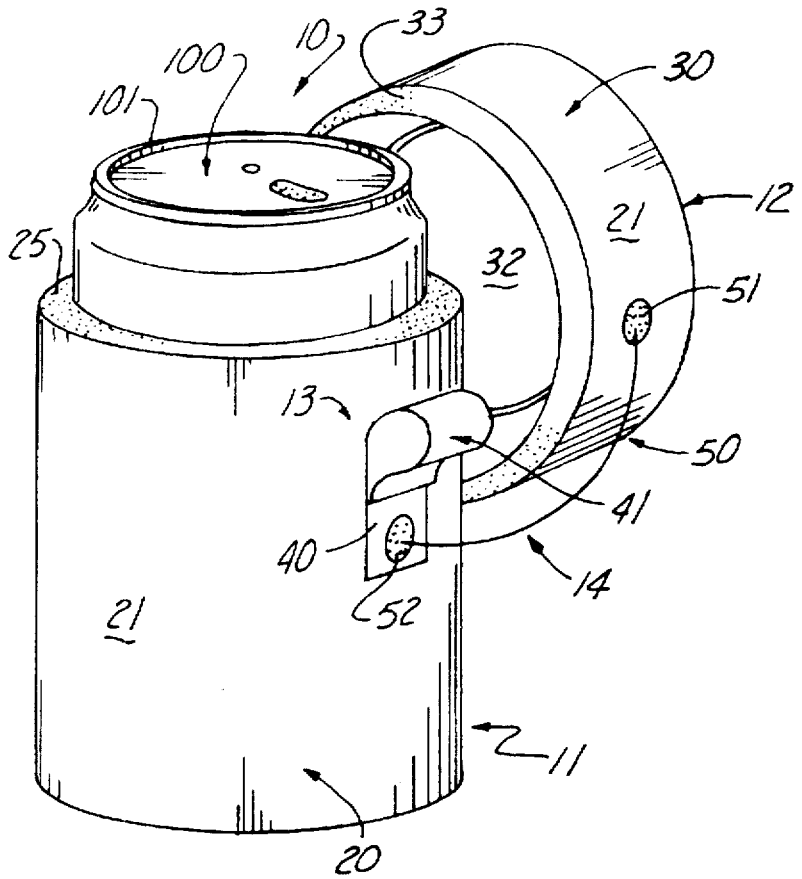
FIG. 1 is an isolated perspective view of the insulated belt attached beverage can holder that forms the basis of the present invention.

As can be seen by reference to the drawings, and in particularly to FIG. 1, the insulated belt attached beverage can holder that forms the basis of the present invention is designated generally by the reference number 10. The beverage can holder 10 comprises in general, a receptacle unit 11, a receptacle lid unit 12, a belt clip unit 13 and a tether/hinge unit 14. These units will now be described in seriatim fashion.

Figure 2:
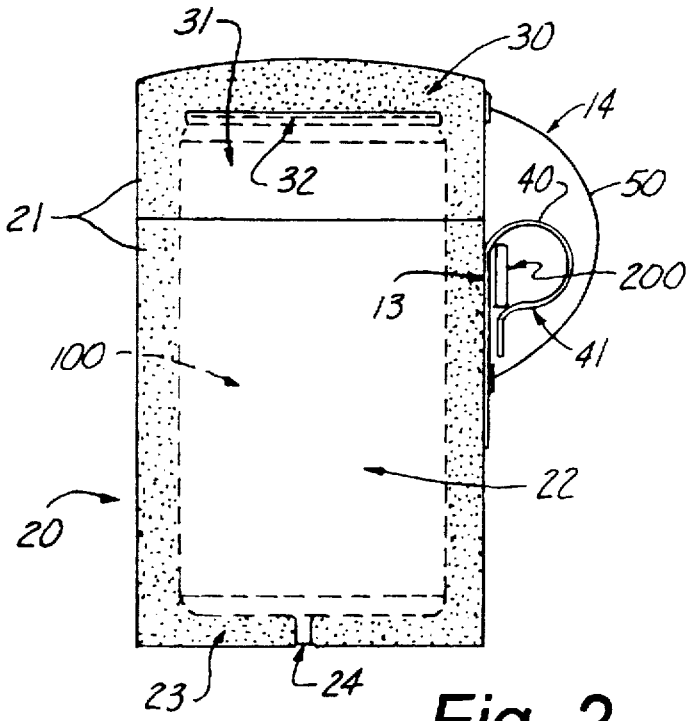
FIG. 2 is a cross sectional view showing the operative engagement of the beverage can holder with a user's belt.

As shown in FIGS. 1 and 2, the receptacle unit 11 comprises a generally elongated cylindrical receptacle member 20 fabricated from insulating material 21. The interior receptacle chamber 22 is dimensioned to snugly receive the sides of a conventional beverage can 100. The bottom portion 23 of the receptacle member 20 may optionally be provided with a vent aperture 24 to facilitate the removal of the can 100 from the receptacle member 20.

In addition, the receptacle lid unit 12 comprises a generally truncated cylindrical receptacle lid member 30 also fabricated from an insulating material 21 wherein the interior chamber 31 of the receptacle lid member 30 is provided with a resilient sealing element 32 which is dimensioned to sealingly engage the peripheral lip 101 of a beverage can 100 when the bottom of the lid member 30 engages the top 25 of the receptacle member 20.

As shown in FIG. 2, the belt clip unit 13 comprises a spring loaded belt clip member 40 operatively secured to the side of the receptacle member 20 and having a resilient capture arm 41 dimensioned to captively engage a portion of a user's belt 200 in a well recognized fashion.

Still referring to FIG. 2, it can be seen that the tether/hinge unit 14 comprises a thin elongated tether member 50 secured on one end 51 to the receptacle lid member 30 and secured on the other end 52 to the receptacle member 20 at a location disposed proximate to, and below the belt receiving opening in the belt clip member 40.

At this juncture, it should be appreciated that the tether member 50 functions primarily as a hinge connection between the receptacle lid member 30 and receptacle member 20. However, due to the placement and elongated slender configuration of the tether member 50, it is also designed to function as a fail safe mechanism or back-up for the belt clip member 40.

In the preferred method of use, the tether member 50 would be slipped between the user's belt 200 and the user's person prior to the belt 200 being fastened in the normal manner. The belt clip member 40 would then engage the belt 200 in the usual fashion.

At this point, given the tight frictional engagement between the receptacle member 20 and the receptacle lid member 30 with the beverage can 100 coupled with the operative engagement of the tether member 50 with the receptacle member 20 and the receptacle lid member 30, a secondary closed loop is formed surrounding the user's belt 200. Then should the belt clip member 40 become disengaged from the user's belt for whatever reason, the secondary closed loop will at least temporarily maintain the beverage holder device in operative engagement with the user's belt 200.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. An insulated belt attached beverage can holder for use with a user's belt to support a conventional beverage can wherein the beverage can holder comprises:

a receptacle member dimensioned to receive the lower portion of the conventional beverage can;

a receptacle lid member dimensioned to receive the upper portion of the beverage can;

first means associated with the receptacle member for captively engaging the user's belt; and second means associated with the receptacle member and the receptacle lid member for captively engaging the user's belt in conjunction with the first means.

2. The beverage can holder as in claim 1 wherein said first means and said second means are different.

3. The beverage can holder as in claim 1 wherein said receptacle member and said receptacle lid member are fabricated from insulating material.

4. The beverage can holder as in claim 1 wherein said first means comprises a belt clip member.

5. The beverage can holder as in claim 4 wherein said second means comprises an elongated tether member.

6. The beverage can holder as in claim 1 wherein said receptacle lid means is provided with, means for sealingly engaging the upper peripheral lip of said beverage can.

* * * * *